US005107660A

United States Patent [19]

Mommeja et al.

[11] Patent Number: 5,107,660

[45] Date of Patent: Apr. 28, 1992

[54] STIRRUP LEATHER BAR FOR A HORSE SADDLE

[75] Inventors: Laurent E. Mommeja; Guy Channel, both of Paris, France

[73] Assignee: Hermes, Paris, France

[21] Appl. No.: 610,914

[22] Filed: Nov. 9, 1990

[30] Foreign Application Priority Data

Nov. 15, 1989 [FR] France ..... 89 14992

[51] Int. Cl.[5] ..... B68C 1/16

[52] U.S. Cl. ..... 54/46

[58] Field of Search ..... 54/44, 46

[56] References Cited

U.S. PATENT DOCUMENTS 4,782,649 11/1988 Zubrod ..... 54/46

FOREIGN PATENT DOCUMENTS 390794 10/1908 France ..... 54/46

4510 of 1910 United Kingdom ..... 54/46

624654 6/1949 United Kingdom ..... 54/46

2053647 2/1981 United Kingdom .

*Primary Examiner*—Robert P. Swiatek

*Attorney, Agent, or Firm*—Sughrue, Mion, Zinn, Macpeak & Seas

[57] ABSTRACT

A stirrup leather bar for a horse saddle (1) adapted to receive a stirrup leather (4) carrying a stirrup (5) and provided with a pivotal member (12) defining two possible positions of adjustment for the stirrup leather, namely a first position (4*a*) in front of the pivotal member (12) in the raised position of the latter which constitutes a stop for the stirrup leather, and a second rear position (4*b*) in which the pivotal member (12) is swung over. This bar enables the horseman to easily find his correct position on the saddle irrespective of the morphology and aptitude of the horseman.

12 Claims, 3 Drawing Sheets

STIRRUP LEATHER BAR FOR A HORSE SADDLE

BACKGROUND OF THE INVENTION

The present invention relates to a stirrup leather bar for a horse saddle arranged to receive a stirrup leather carrying a stirrup.

It is known that stirrup leather bars of a horse saddle function to carry the stirrup leathers and must enable the rider to suitably adjust his longitudinal position on the saddle to achieve equilibrium and a correct positioning.

Unfortunately, conventional stirrup leather bars afford the rider only a single possible position so that some riders encounter difficulties in finding their correct position on the saddle.

SUMMARY OF THE INVENTION

An object of the invention is to overcome this drawback by providing a stirrup leather bar which offers at least two positions of adjustment for the stirrup leather.

According to the invention, the stirrup leather bar is provided with at least one pivotal member defining two possible positions of adjustment for the stirrup leather, namely a first position in front of said member in the raised position of the member which forms a stop for the stirrup leather, and a second rear position in which the pivotal member is swung down.

The rider can in this way choose between the two positions: a forward position in which the end loop of the stirrup leather is blocked at the rear by the raised retaining member constituting a stop and in front by a raised end of the arm of the bar, and a rear position in which the loop of the stirrup leather abuts against the end of the arm of the bar.

This bar thus enables the rider to easily find his position on the saddle irrespective of the morphology and aptitude of the horseman.

In the known manner, the arm of the bar is extended by an element adapted to be pivotally mounted on the saddle and defining with the arm a space for the upper end of the stirrup leather, it being possible to introduce the latter through a gap provided between the confronting ends of the arm and element.

In one embodiment of the invention, the adjusting member for the stirrup leather is a retractable catch pivotally mounted on a transverse pin carried by the arm or by said element and biased by an elastic means disposed in the arm, or in said element, to one of two stable positions, namely a first raised position in which the catch projects into the said space relative to the surface of the arm or element, and a second position in which the catch is retracted into the arm or said element.

Further features and advantages of the invention will be apparent from the following description with reference to the accompanying drawings which illustrate an embodiment of the invention by way of a non-limitative example.

DESCRIPTION OF PREFERRED EMBODIMENTS

Figure 1:
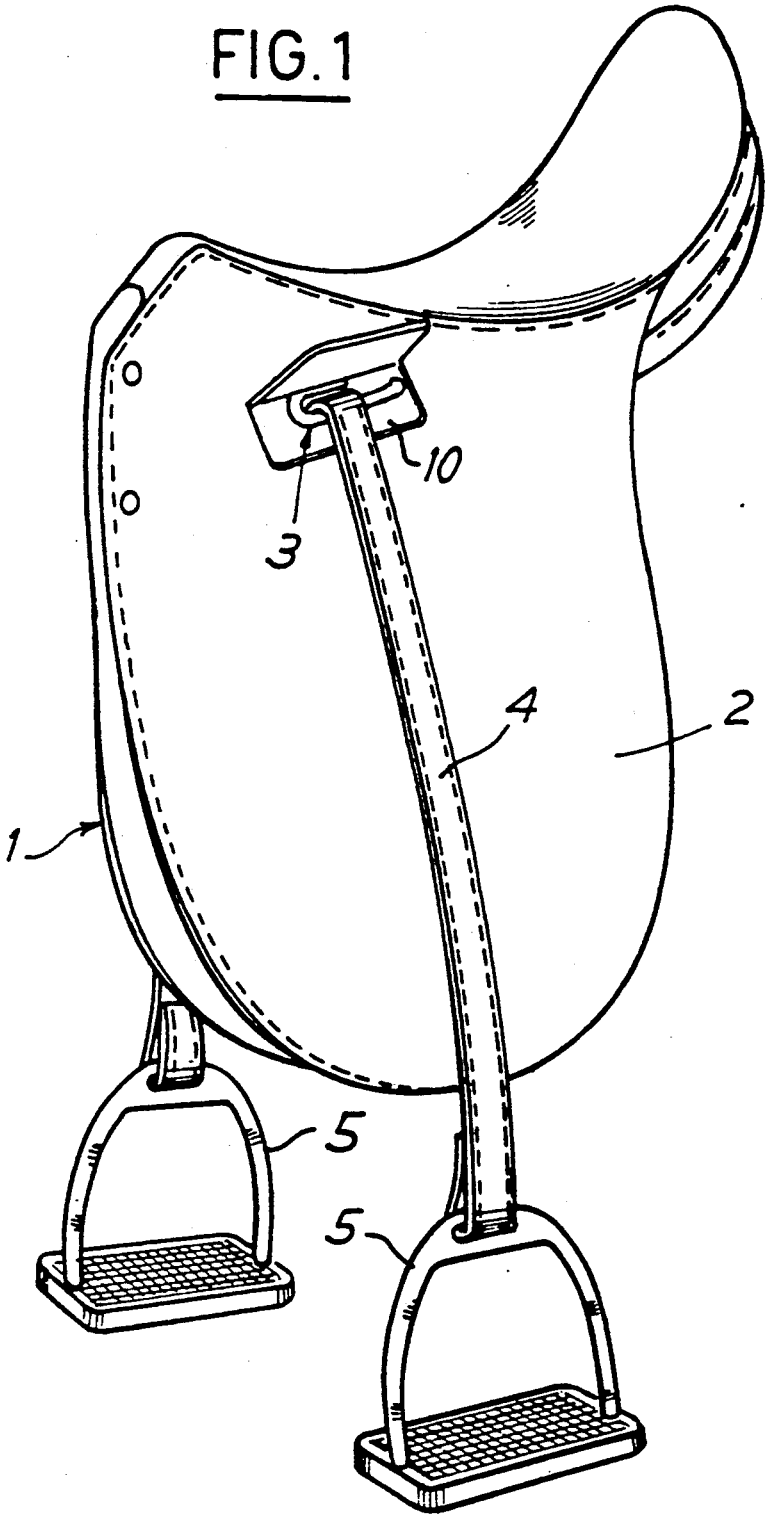
FIG. 1 is a perspective view of a horse saddle and the two stirrup leathers hooked on the corresponding support bars of the saddle, only one of said bars being visible.

The saddle 1 shown in FIG. 1 comprises externally and on each side a flap 2, a bar or support 3 for supporting a stirrup leather 4 at the lower end of which is secured a stirrup 5. The stirrup leather bar 3 is pivotally mounted on a support of the saddle 1 located under the flap 2 which is provided with an opening 10 through which the bar 3 can be passed and placed in position.

In the conventional manner, the bar 3 comprises an arm 6 (FIGS. 2 and 3) extended by an element 7 which extends in a direction roughly parallel to the arm 6 to which it is connected by a curved connection 8. The arm 6 and the element 7 define therebetween a space 9 for the upper end **4*a* of the stirrup leather 4. This end is formed by a loop which may be passed over the arm 6 through a gap 9*a* provided between the ends of the arm 6 and element 7, the inner end of the space 9 being defined by the curved connection 8**.

The element 7 carries a longitudinal pin on which is pivotally mounted a member 11 secured to a support of the saddle 1. The end **6*a* of the arm 6 remote from the curved connection 8 is upwardly curved so as to prevent the upper loop of the stirrup leather 4 from escaping once it is inserted in the space 9**.

The bar 3 is provided with a catch 12 pivotally mounted on the arm 6, preferably in a substantially median zone of the space 9.

The catch 12 is pivotally mounted on a transverse pin 13 of the arm 6 and can take up either of two stable positions in which it is maintained by a spring 14, for example a coil spring, placed under the pin 13 in a cavity 17. The spring 14 is consequently positioned in such manner as to exert on the catch 12, through a plate **14*a* fixed to the end of the spring, a force exerted in a direction perpendicular to the pivot pin 13**.

Figure 2:
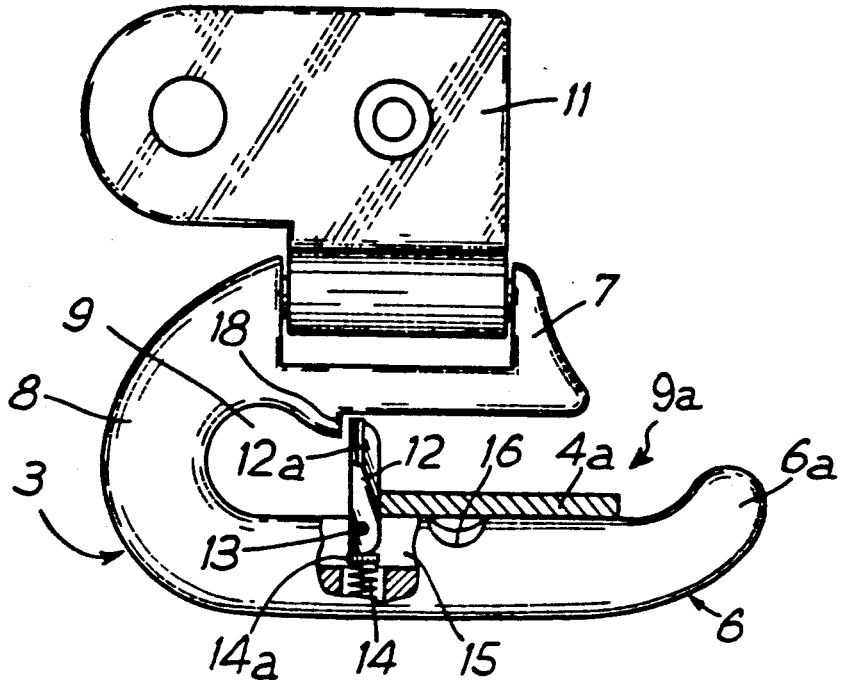
FIG. 2 is a side elevational view to an enlarged scale and with a part cut away, of a stirrup leather bar of the saddle shown in FIG. 1, with its catch raised and the stirrup leather in the forward position.
Figure 3:
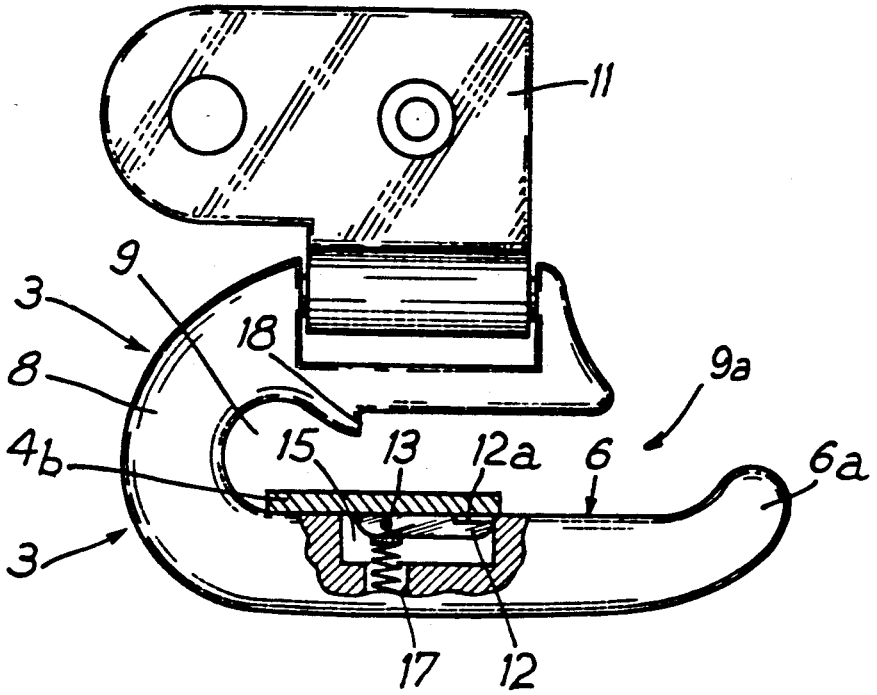
FIG. 3 is a view similar to FIG. 2 of the catch of the bar in the swung over position and the stirrup leather in the rear position.

The catch 12 can in this way be maintained by the spring 14 either in a raised stable position in the space 9 (FIG. 2) perpendicular to the arm 6, or in a swung-over stable position retracted within a longitudinal recess 15 in the arm 6 (FIG. 3). In this second position, the surface of the catch 12 is substantially in the plane of the inner surface of the arm 6, and an end plate **12*a* of the catch 12, provided at the opposite end of the catch 12 to the pin 13, comes to lodge in two corresponding lateral notches 16 in the arm 6**.

Formed on the edge of the element 7 facing the arm 6 is a lug 18 adapted to receive the end of the raised catch 12 and constitutes for the latter a stop in this raised position.

The bar just described is employed in the following manner.

If the horseman desires to place the stirrup leather loop in the forward position (FIG. 2) close to the curved end **6*a*, he manually raises the catch 12 by means of the end plate 12*a* to its position in which it projects into the space 9**.

The spring 14 then holds the catch 12 in this position in which the catch forms a stop for the stirrup leather 4. The lug 18 in addition blocks the catch 12 in its raised position.

If the horseman then desires to place the stirrup leather 4 in the rear position, he extracts the stirrup leather 4 from the bar 3 and then swings the catch 12 over into the arm 6 (FIG. 3). The horseman then places the stirrup leather loop back on the arm 6 and slides it along the catch 12 until it reaches the position **4*b* close to the inner end of the curved connection 8 of the bar 3**.

The scope of the invention is not intended to be limited to the described embodiment. Thus, the spring 14 may be placed on either side of the pin 13 and act on the catch 12 under tension or compression so as to constantly bias the catch towards its raised position.

Figure 4:
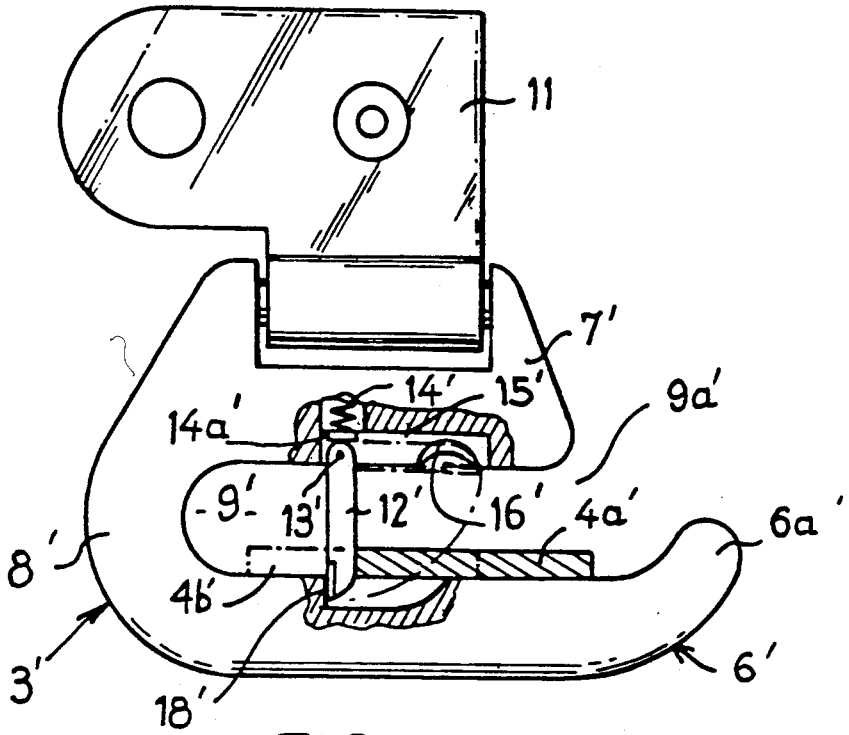
FIG. 4 is a side elevational view, similar to that of FIGS. 2 and 3, and illustrates a second embodiment of the invention.
Figure 5:
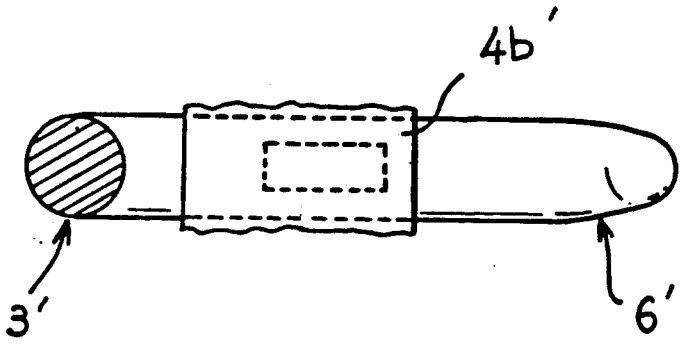
FIG. 5 is a top view of a portion of FIG. 4.

The catch 12 may be pivotally mounted on the element 7 and the lug 18 is then arranged on the arm 6 without any modification in their functions as shown in FIGS. 4 and 5 wherein primed reference numerals refer to corresponding parts indicated by unprimed reference numerals in FIGS. 2 and 3. In FIG. 4, dot-dash lines have been used to show the two positions of the catch 12 and also the corresponding two positions **4*a*', 4*b*' of the stirrup leather 4**.

Lastly, two or even three catches, such as the catch 12, may be provided either on the arm 6 or on the element 7 and spaced apart suitable distances so as to define different positions for the stirrup leather 4 allowing a good positioning of the horseman (the length of the arm 6 being of course correspondingly increased).

What is claimed is:

1. Stirrup leather bar unit for a horse saddle arranged to receive a stirrup leather carrying a stirrup, said bar unit comprising at least one pivotal member defining two possible positions of adjustment for the stirrup leather, namely a first position in front of said at least one member in a raised position of said at least one member which constitutes a stop for said stirrup leather, and a second rear position in which said at least one pivotal member is swung over.

2. Stirrup leather bar unit according to claim 1, comprising an arm, an element extending the arm for pivotal mounting on the saddle and defining with said arm a space for an upper end portion of said stirrup leather, said arm and said element having facing end portions defining a gap communicating with said space and allowing said upper end portion of said stirrup leather access to said space, said at least one pivotal member being a retractable catch pivotally mounted on a transverse pin carried by said arm and, an elastic means associated with said catch and mounted in said arm for maintaining said catch in one of two stable positions, namely a first position in which said catch projects from a surface of said arm into said space, and a second position in which said catch is retracted within said arm.

3. Stirrup leather bar unit according to claim 2, wherein said elastic means is a spring located below said pivot pin of said catch, said spring being arranged to exert on said catch a force in a direction perpendicular to said pivot pin.

4. Stirrup leather bar unit according to claim 3, comprising a recess in said arm for receiving said catch, and notches in said arm on each side of said recess, said catch having an end portion adapted to be capable of engaging in said retracted position in said notches.

5. Stirrup leather bar unit according to claim 2, comprising a recess in said arm for receiving said catch, and notches in said arm on each side of said recess, said catch having an end portion adapted to be capable of engaging in said retracted position in said notches.

6. Stirrup leather bar unit according to claim 2, wherein said element has an edge in facing relation to said arm, and a lug is provided on said edge for receiving an end portion of said catch in said first position of said catch so as to provide a stop for said catch.

7. Stirrup leather bar unit according to claim 1, comprising an arm, an element extending the arm for pivotal mounting on the saddle and defining with said arm a space for an upper end portion of said stirrup leather, said arm and said element having facing end portions defining a gap communicating with said space and allowing said upper end portion of said stirrup leather access to said space, said at least one pivotal member being a retractable catch pivotally mounted on a transverse pin carried by said element, and an elastic means associated with said catch and mounted in said element for maintaining said catch in one of two stable positions, namely a first position in which said catch projects from a surface of said element into said space, and a second position in which said catch is retracted within said element.

8. Stirrup leather bar unit according to claim 7, comprising a recess in said element for receiving said catch and notches in said element on each side of said recess, said catch having an end portion adapted to be capable of engaging in said retracted position in said notches.

9. Stirrup leather bar unit according to claim 7, wherein said arm has an edge in facing relation to said element, and a lug is provided on said edge for receiving an end portion of said catch in said first position of said catch so as to provide a stop for said catch.

10. Stirrup leather bar unit according to claim 7, wherein said elastic means is a spring located above said pivot pin of said catch, said spring being arranged to exert on said catch a force in a direction perpendicular to said pivot pin.

11. Stirrup leather bar unit according to claim 10, comprising a recess in said element for receiving said catch and notches in said element on each side of said recess, said catch having an end portion adapted to be capable of engaging in said retracted position in said notches.

12. Stirrup leather bar unit according to claim 1, comprising:

an arm portion;

an element portion extending the arm portion for pivotal mounting on the saddle and defining with said arm portion a space for an upper end portion of said stirrup leather, said arm portion and said element portion having facing end portions defining a gap communicating with said space and allowing said upper end portion of said stirrup leather access to said space, said at least one pivotal member being a retractable catch pivotally mounted on a transverse pin carried by one of said portions; and an elastic means associated with said catch and mounted in said one portion for maintaining said catch in one of two stable positions, namely a first portion in which said catch projects from a surface of said one portion into said space, and a second position in which said catch is retracted within said one portion;

wherein said other portion has an edge in facing relation to said one portion, and a lug is provided on said edge for receiving an end portion of said catch in said first position of said catch so as to provide a stop for said catch.

* * * * *